US007044716B2

(12) United States Patent
Fabry

(10) Patent No.: US 7,044,716 B2
(45) Date of Patent: May 16, 2006

(54) HIGH-PRESSURE MULTI-STAGE CENTRIFUGAL COMPRESSOR

(75) Inventor: Erik Paul Fabry, Tervuren (BE)

(73) Assignee: Atlas Copco Airpower, naamloze vennootschap, (BE)

( * ) Notice: Subject to any disclaimer, the term of this patent is extended or adjusted under 35 U.S.C. 154(b) by 145 days.

(21) Appl. No.: 10/363,863

(22) PCT Filed: Sep. 17, 2001

(86) PCT No.: PCT/BE01/00156

§ 371 (c)(1),
(2), (4) Date: Mar. 17, 2003

(87) PCT Pub. No.: WO02/25117

PCT Pub. Date: Mar. 28, 2002

(65) Prior Publication Data

US 2003/0175128 A1 Sep. 18, 2003

(30) Foreign Application Priority Data

Sep. 19, 2000 (BE) ..... 2000/0596

(51) Int. Cl.
*F04B 23/00* (2006.01)
*F04B 25/00* (2006.01)

(52) U.S. Cl. ..... 417/243; 417/244; 417/423.5

(58) Field of Classification Search ..... 417/243, 417/244, 350, 423.5
See application file for complete search history.

(56) References Cited

U.S. PATENT DOCUMENTS

| | | | | |
|---|---|---|---|---|
| 3,477,636 | A * | 11/1969 | Gessner | 415/100 |
| 4,105,372 | A * | 8/1978 | Mishina et al. | 417/243 |
| 4,969,803 | A * | 11/1990 | Turanskyj | 417/247 |
| 5,791,159 | A | 8/1998 | Aicher et al. | |
| 5,980,218 | A * | 11/1999 | Takahashi et al. | 417/243 |
| 6,050,080 | A * | 4/2000 | Horner | 60/784 |
| 6,802,696 | B1 * | 10/2004 | Verhaegen | 417/2 |

FOREIGN PATENT DOCUMENTS

| | | |
|---|---|---|
| DE | 199 32 433 | 1/2000 |
| EP | 0 297 691 | 1/1989 |
| GB | 2024328 A * | 1/1980 |
| NL | 106 824 | 12/1963 |

OTHER PUBLICATIONS

Garay, "Pump Application Desk Book", The Fairmont Press, third edition, p. 13 and 281-285.*

* cited by examiner

*Primary Examiner*—Charles G. Freay
(74) *Attorney, Agent, or Firm*—Bacon & Thomas PLLC

(57) ABSTRACT

A high-pressure multi-stage centrifugal compressor is provided containing at least three compressor elements which are arranged in series as compressor stages, and at least two electric motors to drive these compressor elements. At least one compressor element forms a low-pressure stage which is driven by an electric motor. At least two compressor elements form high-pressure stages, and are arranged in series and driven by one and the same second electric motor.

6 Claims, 1 Drawing Sheet

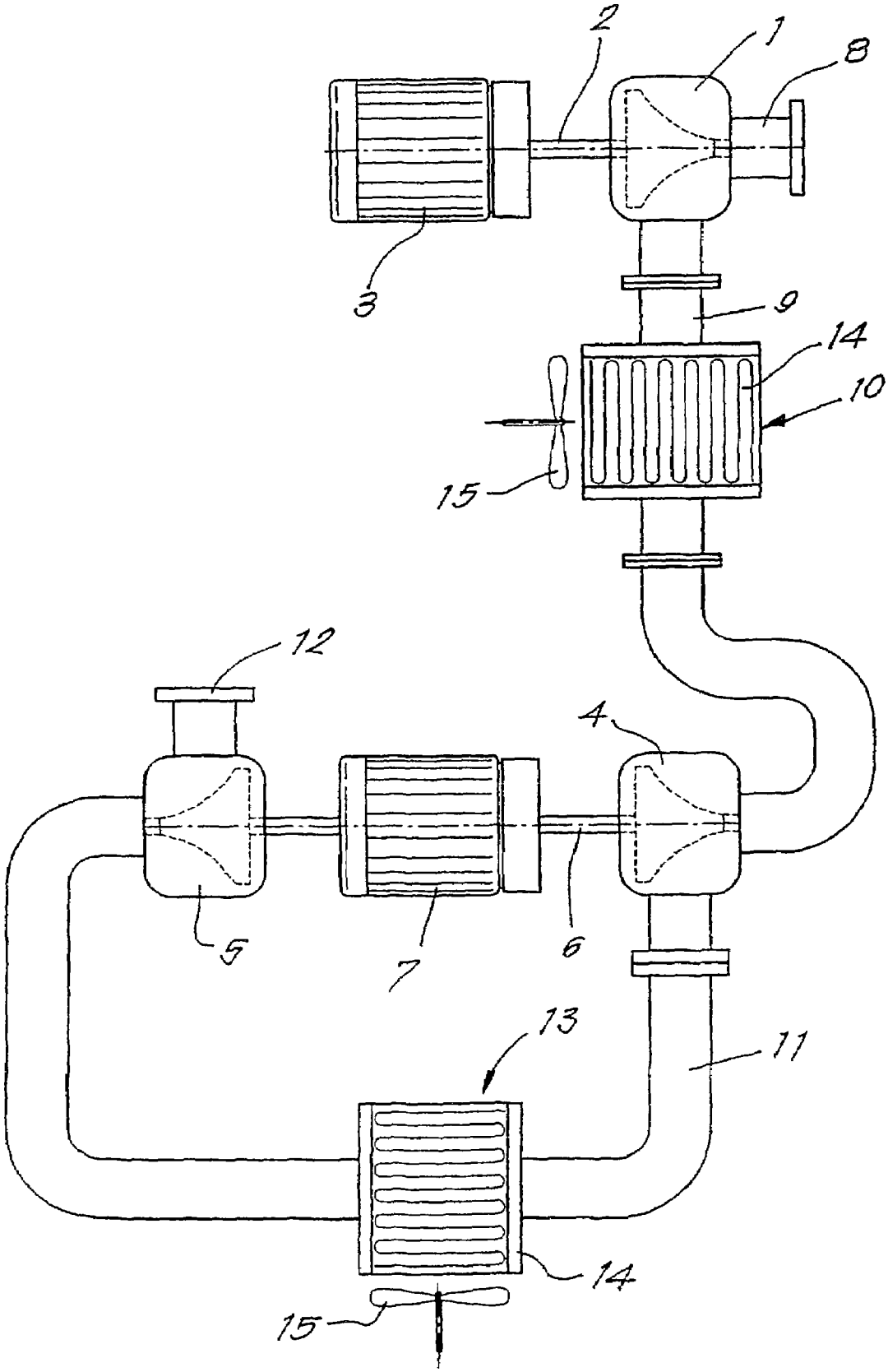
2
1
8
3
9
14
10
15
12
4
5
7
6
13
11
14
15

HIGH-PRESSURE MULTI-STAGE CENTRIFUGAL COMPRESSOR

FIELD OF THE INVENTION

The present invention concerns a high-pressure multi-stage centrifugal compressor containing at least three compressor elements which are arranged in series as compressor stages, and at least two electric motors to drive these compressor elements.

BACKGROUND

A centrifugal compressor element has a high efficiency when its specific speed is situated close to the optimal value. The specific speed Ns is defined as:

$$Ns = C' \cdot \frac{N \cdot \sqrt{Q_{vol}}}{DH^{0.75}}$$

whereby:

N=the rotational speed of the blade wheel, $Q_{vol}$=the volumetric flow on the inlet, C'=a constant which is amongst others different as a function of the units used, DH=the adiabatic head of the compressor:

$$DH = cp \cdot T \cdot \left(\pi^{\frac{k-1}{k}} - 1\right)$$

whereby:

π=the pressure ratio,

T=the inlet temperature, cp=the specific heat of the gas at a constant pressure, k=the ratio of the specific heat of the gas at the constant pressure and the specific heat of the gas at a constant volume.

In order to obtain a good efficiency, and thus a low specific consumption or energy consumption per quantity of compressed air, it is necessary to select the parameters in the design of a compressor element such that Ns is situated close to the optimum.

In fact, the equation for Ns indicates that for designs having the same flow, the rotational speed has to rise for a higher pressure ratio, and for designs with a constant pressure ratio, the rotational speed has to rise for a smaller flow.

Centrifugal compressors are known whereby the shafts of the compressor elements are driven directly by electric motors at a high speed of rotation.

Such centrifugal compressors require less stages to obtain a high pressure ratio than the conventional centrifugal compressors which are driven directly by high-speed motors at a low speed.

High-speed motors are characterised by a characteristic value $M=P.N^2$ which is larger than or equal to $0{,}1.10^{12}$, whereby P is the engine power expressed in kW and N is the rotational speed expressed in rotations per minute.

The fast drive allows for a higher pressure ratio per stage. Less stages means less loss.

Such centrifugal compressors avoid the use of a gearbox as in conventional centrifugal compressors with a drive via a gearbox which implies a great deal of losses, requires oiling and occupies much space.

Moreover, a high-speed motor is much smaller than a conventional, slow electric motor.

The high-speed motor is equipped with adjusted bearings for these high rotational speeds. When air bearings or magnetic bearings are used, no oil is required, and the compressor is entirely oil-free, which offers an additional advantage in relation to compressors with bearings requiring oil lubrication.

The problem resides in the restriction of the power and the rotational speed of the high-speed motor, and the needs for a centrifugal compressor for high pressure.

Electric high-speed motors are characterised by a small volume and consequently a high energy density. Given the small dimensions, the cooling causes a specific problem.

The ratio of the applied power P and the dischargeable power (h.A) is the dimensionless value M'=P/(h.A). Hereby is A the reference heat-exchanging surface, and h is the effective heat transfer coefficient between the hot motor and the colder environment, possibly via a cooling system with heat exchanger.

The surface is proportional to the square of the specific length of the motor, namely the radius of the rotor R. Also the characteristic value M' can be represented as:

$$M' = \frac{P}{h \cdot R^2}$$

The radius of the rotor also is the relation of V to N, whereby N is the rotational speed of the motor and V is the tip speed of the rotor. Thus, M' can be represented as:

$$M' = \frac{P \cdot N^2}{h \cdot V^2}$$

For a given type of heat exchange, h is a constant, and for a given material, V is restricted as a result of centrifugal tensions.

Consequently, the characteristic value $M=P.N^2$ is a value which indicates the level of difficulty of the design and the construction of the electric motor. The higher the value M, the more difficult it is to cool the motor. A high value M requires more efficiency (so that less losses have to be discharged), a better heat transfer coefficient and a higher strength of material.

In practice, this implies that a motor having a higher characteristic value M requires a more expensive design, and that the development will take longer than for a motor having a lower characteristic value M.

For a turbocompressor, the power required is equal to:

$$P = \frac{Q \cdot DH}{\eta} = \frac{\rho \cdot Q_{vol} \cdot cp \cdot T \cdot \left(\pi^{\frac{k-1}{k}} - 1\right)}{\eta}$$

whereby:

θ=the adiabatic efficiency of the compressor,

ρ=the density of the gas,

Q=the mass flow.

The number of revolutions N is selected as a function of a good specific rotational speed Ns $$N = \frac{Ns \cdot DH^{0.75}}{C' \cdot \sqrt{Q_{vol}}}$$

from which appears the following:

$$M = P \cdot N^2 = \frac{Ns^2 \cdot cp^{2.5}}{C'^2 \cdot \eta} \cdot \rho \cdot \left[T \cdot \left(\pi^{\frac{k-1}{k}} - 1\right)\right]^{2.5} = C \cdot \rho \cdot \left[T \cdot \left(\pi^{\frac{k-1}{k}} - 1\right)\right]^{2.5}$$

C is hereby a constant. This equation indicates that an electric motor for a centrifugal compressor which is driven directly is more difficult to realise for a higher pressure ratio ($\pi$) and for a high-pressure stage, this is with a higher density at the inlet.

It is clear from this argumentation that a compression to high pressures in a single stage is extremely difficult to realise with a single drive.

That is why a solution must be found to nevertheless keep the characteristic value M low.

An obvious solution is to carry out the compression in more than one stage, thereby using more than one motor, for example one motor for the low-pressure stage and one motor for the high-pressure stage.

However, from the last equation it is clear that the higher pressure for the high-pressure stage is coupled with a much higher characteristic value M. This is difficult to realise.

Consequently, the designer has to be content with a lower Ns and hence less efficiency.

A restricted improvement can be obtained by providing for an optimal distribution of the pressure ratios of the low- and high-pressure stages, namely by setting the pressure ratio in the first stages higher than the pressure ratios of the last stages.

However, said improvement is restricted, since for pressure ratio's which are larger than three, the Mach value losses (shock losses) strongly increase.

SUMMARY OF THE INVENTION

The invention aims to remedy the above-mentioned disadvantages and it allows to restrict the characteristic value M of the electric motor for the high-pressure stage in a multi-stage compressor without the specific rotational speed of the centrifugal compressor elements having to deviate much from the optimal specific speed.

This aim is reached according to the invention in that the centrifugal compressor contains, apart from at least one compressor element forming a low-pressure stage and which is driven by an electric motor, at least two compressor elements forming high-pressure stages and which are arranged in series and are driven by one and the same second electric motor.

In fact, what it comes down to, is that the high-pressure stage from a known multi-stage centrifugal compressor is replaced by at least two high-pressure stages which are driven by one and the same high-speed motor, however. This strongly reduces the pressure ratio for the high-pressure stages, as a result of which the rotational speed can be relatively low.

The compressor elements forming the high-pressure stages can be mounted together with their rotors on one and the same shaft which is driven by the second motor.

Moreover, the pressure ratios for these high-pressure stages can be selected such that the specific speeds of these high-pressure stages do not deviate much from the optimal specific speed.

Preferably, the motors are identical to one another, which implies that they have the same electromagnetic stator part and/or the same electromagnetic rotor part and/or the same bearings and/or the same cooling part.

The motors are preferably high-speed motors.

The centrifugal compressor may contain an intercooler for the compressed gas between the compressor elements of the above-mentioned high-pressure stages placed in series.

In order to better explain the characteristics of the invention, the following preferred embodiments of a high-pressure multi-stage centrifugal compressor according to the invention are described as an example only without being limitative in any way, with reference to the accompanying drawing in which is represented such a centrifugal compressor according to the invention.

DETAILED DESCRIPTION

The high-pressure centrifugal compressor represented in the FIGURE mainly consists of a low-pressure stage formed of a first compressor element 1 whose rotor is driven via a shaft 2 by a first electric high-speed motor 3 and two high-pressure stages formed by two compressor elements 4 and 5 arranged in series which are fixed with their rotors on one and the same shaft 6, however, and which are thus driven via one and the same shaft 6 by a single second high-speed motor 7.

The compressor element 1 onto which the intake pipe 8 is connected, is connected to the compressor element 4 with its compressed air line 9. In this compressed air line is mounted an intercooler 10 cooled with ambient air or cooling water.

The compressed air line 11 of the compressor element 4 is connected to the compressor element 5 which is provided with a compressed air line 12 on its outlet. In the first-mentioned compressed air line 11, between the compressor elements 4 and 5, is arranged an additional intercooler 13 cooled with ambient air or cooling water.

The intercoolers 10 and 13 may consist of a radiator 14 through which flows the compressed gas and opposite to which is erected a fan 15.

The pressure ratios of the two high-pressure stages and thus of the two compressor elements are selected such that their specific rotational speed Ns does not deviate much from the optimal one.

Moreover, in the embodiment represented, these pressure ratios are also selected such that the same motors can be used. The high-speed motors 3 and 7 are thus equal to one another, which implies that they have the same electromagnetic stator part and/or the same electromagnetic rotor part and/or the same bearings and/or the same cooling part.

Gas which is sucked in by the intake pipe 8, for example air, is first compressed at a low pressure by the low-pressure compressor element 1, and subsequently brought at the final pressure in two stages, by the compressor elements 4 and 5 successively.

By splitting the high-pressure stage in two stages, the pressure ratio $\pi$ per stage or compressor element strongly decreases, so that the required rotational speed N of the high-speed motor 7 strongly decreases.

The three combined stages make it possible to go from atmospheric conditions to an effective pressure of 7 to 8,6 bar, without exceeding the pressure ratio of three per stage. Consequently, the number of parts is limited and the shock losses are restricted as well.

The additional intermediate cooling of the air between the replacing stages placed in series offers an additional advantage in that there is less consumption of electric energy.

Although using identical motors implies an economic scale advantage and offers the advantage of modularity with a restricted number of different parts, the high-speed motors 3 and 7 can nevertheless be different from one another in other embodiments.

Nor is it absolutely necessary that the number of high-pressure stages driven by the same high-speed motor 7 is exactly two. There can be three or more high-pressure stages.

Also, the centrifugal compressor can contain several low-pressure stages in series which each contain a compressor element driven by its own high-speed motor.

The invention is by no means limited to the above-described embodiments represented in the accompanying drawing; on the contrary, such a high-pressure multi-stage centrifugal compressor can be made in all sorts of variants while still remaining within the scope of the invention.

The invention claimed is:

1. High-pressure multi-stage centrifugal compressor comprising at least three compressor elements which are arranged in series as compressor stages, and at least two electric motors to drive said compressor elements, wherein, apart from at least one of said compressor elements forming a low-pressure stage and which is driven by an electric motor, said multi-stage centrifugal compressor contains at least two of said compressor elements forming high-pressure stages, and which are arranged in series and are driven by one and the same second electric motor.

2. High-pressure multi-stage centrifugal compressor according to claim 1, wherein the compressor elements forming the high-pressure stages are mounted with their rotors on one and the same shaft which is driven by the second electric motor.

3. High-pressure multi-stage centrifugal compressor according to claim 1 wherein the pressure ratios for the high-pressure stages whose compressor elements are driven by one and the same motor have been selected such that the specific speeds of these high-pressure stages do not deviate much from the optimal specific speed.

4. High-pressure multi-stage centrifugal compressor according to claim 1, wherein the motors are identical to one another and thus have the same electromagnetic stator part and/or the same electromagnetic rotor part and/or the same bearings and/or the same cooling part.

5. High-pressure multi-stage centrifugal compressor according to claim 1, wherein the motors are high-speed motors.

6. High-pressure multi-stage centrifugal compressor according to claim 1, wherein the compressor contains an intercooler for the compressed gas which is arranged between the compressor elements of said high-pressure stages placed in series.

* * * * *